US007638698B1

(12) United States Patent
Bellissimo

(10) Patent No.: US 7,638,698 B1
(45) Date of Patent: Dec. 29, 2009

(54) HARMONICA REMOVABLY ATTACHED TO A MUSICAL STRING INSTRUMENT SUCH AS A GUITAR

(76) Inventor: Emilio T. Bellissimo, 22522 Clarendon St., Woodland Hills, CA (US) 91367

( * ) Notice: Subject to any disclaimer, the term of this patent is extended or adjusted under 35 U.S.C. 154(b) by 41 days.

(21) Appl. No.: 12/006,564

(22) Filed: Jan. 3, 2008

(51) Int. Cl.
*G10G 7/00* (2006.01)

(52) U.S. Cl. ..... 84/379; 84/377; 84/327; 84/329

(58) Field of Classification Search ..... 84/327, 84/329, 377, 379
See application file for complete search history.

(56) References Cited

U.S. PATENT DOCUMENTS

| | | | | | |
|---|---|---|---|---|---|
| 397,541 | A * | 2/1889 | Gaertner | 84/379 |
| 1,912,654 | A * | 6/1933 | Peterson | 84/379 |
| 2,540,340 | A * | 2/1951 | Linblade | 43/57.1 |
| 3,665,490 | A * | 5/1972 | Oskar | 381/366 |
| 3,886,508 | A * | 5/1975 | Lavrard | 335/285 |
| D279,905 | S * | 7/1985 | Whited | D17/13 |
| 4,785,708 | A * | 11/1988 | Vaughan | 84/329 |
| 4,790,232 | A * | 12/1988 | Rosen | 84/329 |
| 5,593,073 | A * | 1/1997 | Finnegan | 224/183 |
| 5,718,364 | A * | 2/1998 | McDowell | 224/603 |
| 5,739,445 | A * | 4/1998 | Terry et al. | 84/329 |
| 5,760,668 | A * | 6/1998 | Testa et al. | 335/285 |
| 6,530,508 | B1 * | 3/2003 | Devine | 224/183 |
| 6,933,430 | B2 * | 8/2005 | Oskorep | 84/322 |
| 7,146,651 | B1 * | 12/2006 | Lapin | 2/338 |
| 7,238,871 | B1 * | 7/2007 | Stroscio | 84/329 |

* cited by examiner

*Primary Examiner*—Jeffrey Donels
*Assistant Examiner*—Robert W Horn
(74) *Attorney, Agent, or Firm*—Thomas I. Rozsa

(57) ABSTRACT

The present invention is an apparatus which enables a harmonica to be removably attached to a string instrument such as a guitar without having to modify the physical aspects of the guitar and which retains the harmonica so that it can be immediately located and grasped into a playing condition so that a musician can play the guitar or other string instrument, immediately switch to playing the harmonica, and then return the harmonica to its location on the guitar and continue to play the guitar. More broadly defined, the present invention includes the concept of removably retaining a first musical instrument to a second musical instrument by a magnet.

3 Claims, 6 Drawing Sheets

HARMONICA REMOVABLY ATTACHED TO A MUSICAL STRING INSTRUMENT SUCH AS A GUITAR

BACKGROUND OF THE INVENTION

1. Field of the Invention

The present invention relates to the field of musical instruments and in particular to harmonicas and string instruments such as guitars.

2. Description of the Prior Art

The present inventor is a very talented musician who has played with some of the most prominent bands in the world. The present inventor plays both guitar and harmonica. Frequently during a concert, there is a need to immediately switch from playing the guitar to playing the harmonica. The harmonica is a small instrument and it is easily misplaced. Even if carried in a shirt or pants pocket, there is a significant delay in finding and the grasping the harmonica to play it. One alternative is to have the harmonica retained on a shoulder holder such as used by musician Bob Dylan, but this is unsightly and unattractive.

To the best of the present inventor's knowledge, there is no apparatus which provides a means to quickly locate and hold a harmonica to be immediately played after the same musician has temporarily stopped playing the guitar or other string instrument. There is a significant need for such an apparatus to facilitate the transition from playing a string instrument such as a guitar to playing a harmonica, and then back to playing the string instrument during a concert.

SUMMARY OF THE INVENTION

The present invention is an apparatus which enables a harmonica to be removably attached to a string instrument such as a guitar without having to modify the physical aspects of the guitar and which retains the harmonica so that it can be immediately located and grasped into a playing condition so that a musician can play the guitar or other string instrument, immediately switch to playing the harmonica, and then return the harmonica to its location on the guitar and continue to play the guitar. More broadly defined, the present invention includes the concept of removably retaining a first musical instrument to a second musical instrument by a magnet.

It is been discovered, according to the present invention, that if an attachment apparatus comprises an attaching means by which it is permanently attached to the body of a string instrument such as a guitar and also retains a removable attachment means by which a harmonica is removably attached to the attaching means, then the harmonica can be removably retained on the guitar so that a musician can play the guitar or other string instrument, immediately switch to playing the harmonica, and then return the harmonica to its location on the attaching means on the guitar and continue to play the guitar.

It has further been discovered, according to the present invention, that if the attaching means further comprises two sided tape, then the attaching means can be permanently attached to the guitar or other string instrument in a manner which will not require any physical modification to the guitar or other string instrument.

It has additionally been discovered, according to the present invention, that if the attaching means retains a magnet, then the magnet will removably hold the harmonica so that the harmonica can be removably retained on the attaching means and therefore removably retained on the guitar.

It has also been discovered, according to the present invention, that if the removable attaching means is located on the upper side of the guitar, then the harmonica is positioned so that it can be quickly located and grasped for playing to thereby facilitate a rapid transition for playing the guitar to playing the harmonica and then back to playing the guitar.

It is therefore an object of the present invention to provide an attachment apparatus which comprises an attaching means by which it is permanently attached to the body of a string instrument such as a guitar and also retains a removable attachment means by which a harmonica is removably attached to the attaching means, so that the harmonica can be removably retained on the guitar so that a musician can play the guitar or other string instrument, immediately switch to playing the harmonica, and then return the harmonica to its location on the attaching means on the guitar and continue to play the guitar.

It is a further object of the present invention to provide an attaching means which further comprises two sided tape so that the attaching means can be permanently attached to the guitar or other string instrument in a manner which will not require any physical modification to the guitar or other string instrument.

It is an additional object of the present invention to provide an attaching means which retains a magnet so that the magnet will removably hold the harmonica so that the harmonica can be removably retained on the attaching means and therefore removably retained on the guitar.

It is also an object of the present invention to provide a removable attaching means which is located on the upper side of the guitar so that the harmonica is positioned so that it can be quickly located and grasped for playing to thereby facilitate a rapid transition for playing the guitar to playing the harmonic and then back to playing the guitar.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 4:
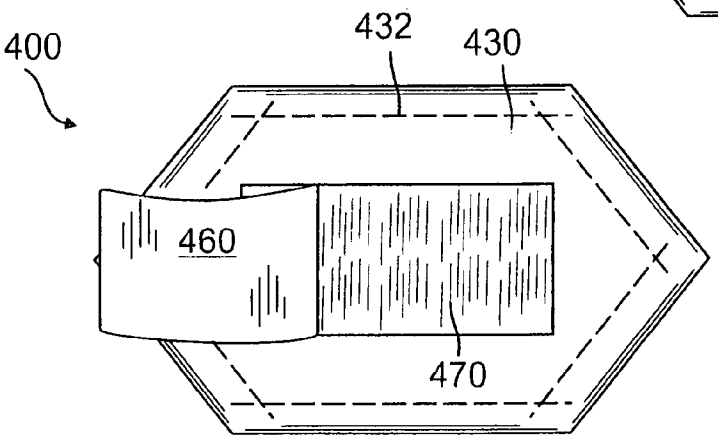
FIG. 4 is a bottom plan view of a preferred embodiment of an attaching means of the present invention with the double sided tape in the uncovered condition.
Figure 5:
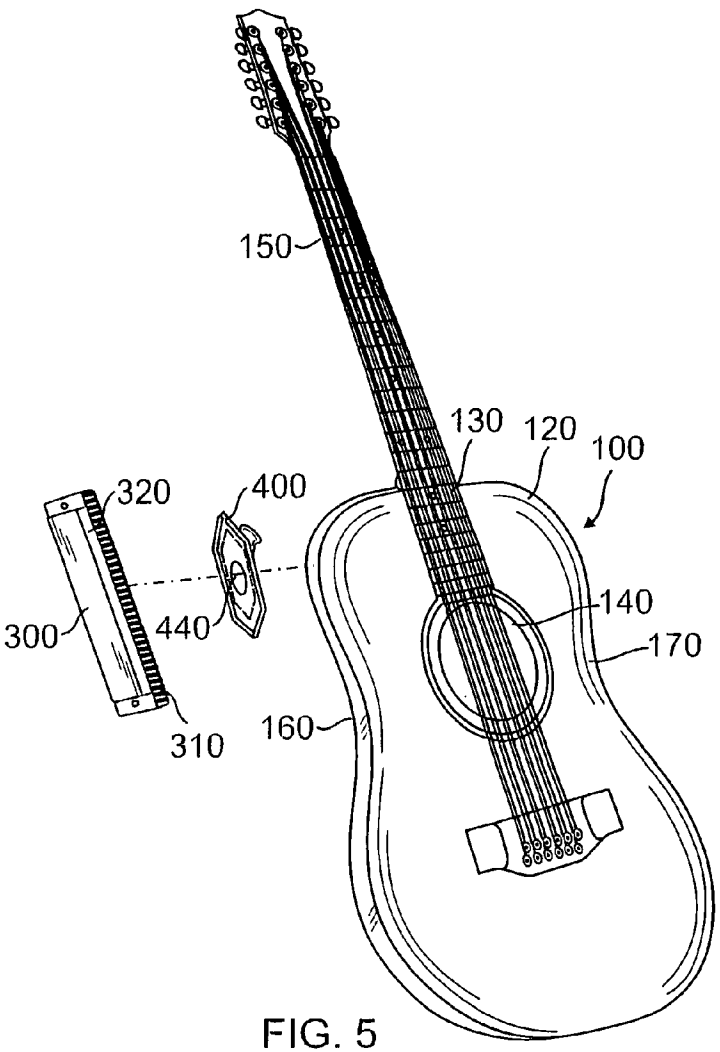
FIG. 5 is an exploded perspective view of a guitar, the attaching means and a harmonica inverted to show the playing mouthpiece to show how the assembly is connected together and is retained on one alternative embodiment as illustrated in FIG. 1B.
Figure 5A:
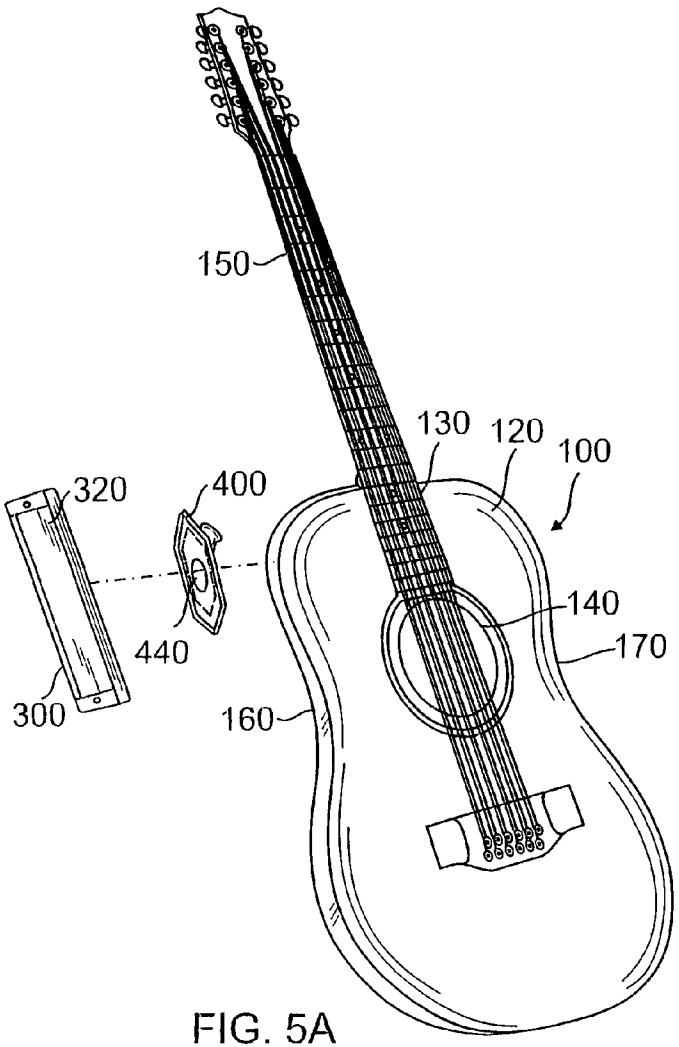
FIG. 5A is an exploded perspective view of a guitar, the attaching means and a harmonica with its metal portion facing the attaching means to show how the assembly is connected together and as retained in the preferred orientation illustrated in FIG. 1A.

Referring first to FIGS. 5 and 5A, there is illustrated a string instrument which is a guitar 100 having a body 120 attached to a neck 130 with an opening 140 in the body 120 and a multiplicity of strings 150 extending from the body 120 over the opening 140 and over the neck 130. The guitar body 120 has an upper or top side 160 which is the part of the guitar 100 closest to the chest and face of the musician and closest to the musician's hands. Placed away from the guitar in the exploded view is the attaching means 400 which will described in greater detail with reference to FIGS. 2 through 4. Placed away from the guitar 100 and attaching means 400 is the harmonica 300 which has a mouth opening 310 into which air from the musician's mouth is blown when the harmonica is played. The body 320 of the harmonica is made of metal which can be attracted by a magnet.

Figure 2:
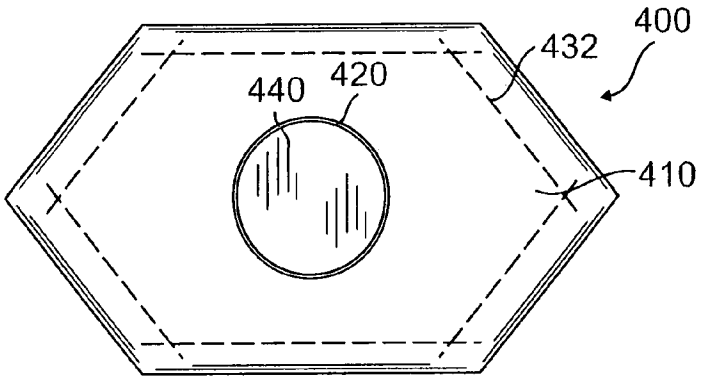
FIG. 2 is a top plan view of a preferred embodiment of an attaching means of the present invention.
Figure 3:
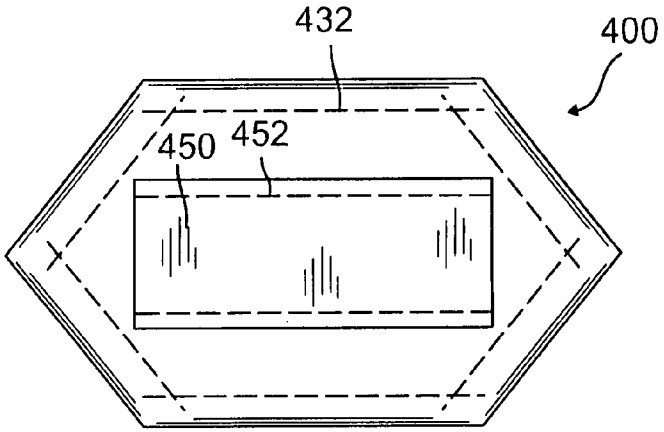
FIG. 3 is a bottom plan view of a preferred embodiment of an attaching means of the present invention with the double sided tape in the covered condition.

Referring to FIGS. 2 through 4, the attaching means 400 is comprised of a body having an upper layer 410 with an opening 420 and a lower layer 430 which is attached to the upper body 410 by mean such as stitching 432 if the upper and lower body sections are made of leather or other material which can be sewn together. A magnet 440 is retained between the upper layer 410 and the lower layer 430 so that the magnet is visible through the opening 420. The lower layer 430 comprises a double sided tape 450 which is attached at one side to the lower layer 430 by adhesive and also optionally by stitching 452 and is covered on its opposite side by covering means 460. When the covering means 460 is peeled away as illustrated in FIG. 4, the adhesive portion 470 is exposed.

Figure 1A:
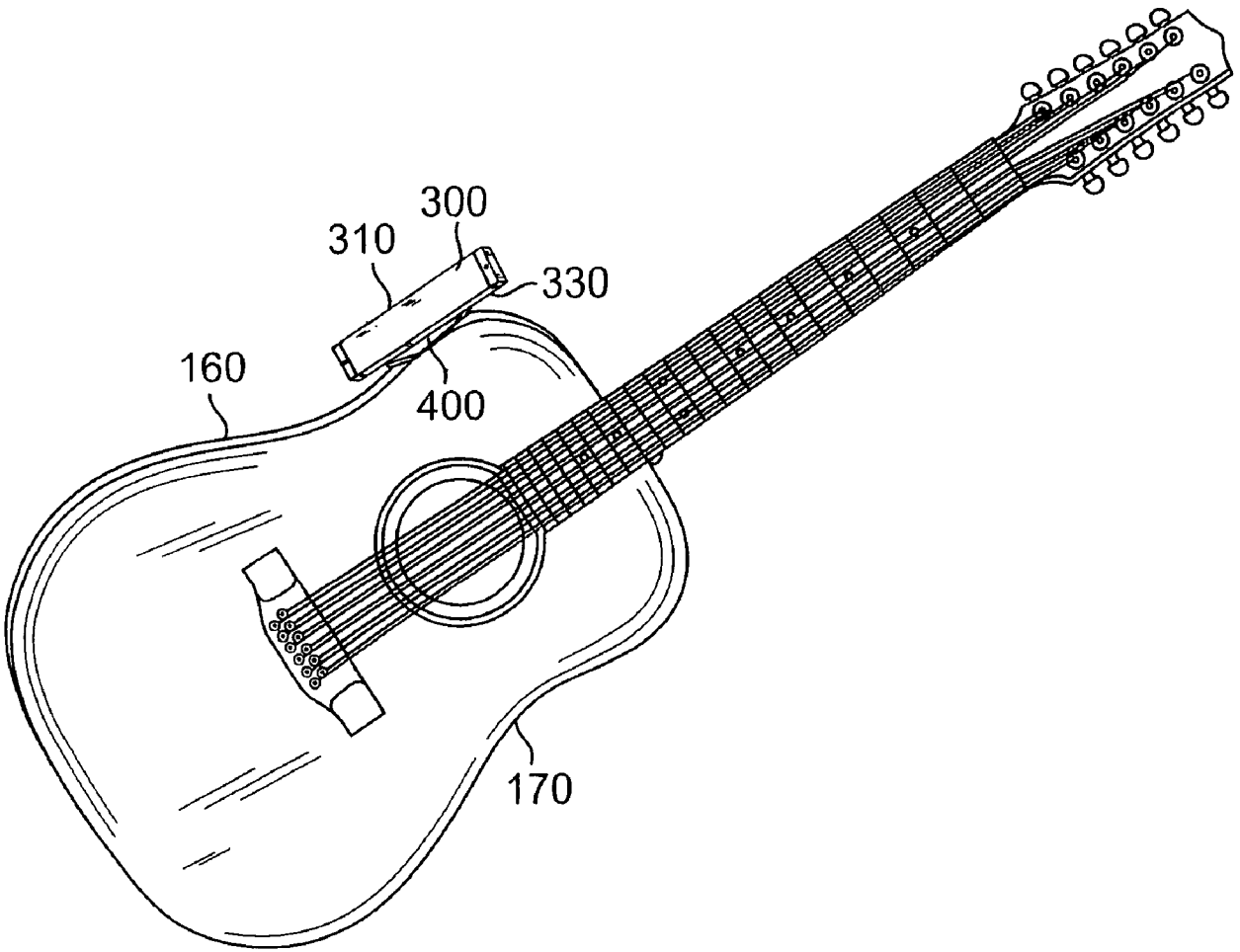
FIG. 1A is a perspective view of a guitar and a harmonica, with the harmonica being removably attached to the upper side of the guitar by the attaching means, with the harmonica retained in a preferred orientation.

Referring to the exploded view in FIG. 5A, the adhesive portion 470 of the double sided tape 450 is affixed to the top side 160 of guitar 100 so that the attaching means 400 is permanently attached to the top side 160 of the guitar 100. The magnet 440 extends away from the top side 160 of the guitar 100. The harmonica 300 is oriented as illustrated in FIG. 5A so that the bottom 330 of the metal portion of the body 320 faces the magnet 440 in the preferred orientation where the mouth opening 310 faces the musician so that the harmonica 300 can be easily grasped in one hand and is ready for playing. The completed assembly in the preferred orientation is illustrated in FIG. 1A. The harmonica 300 is removably retained to the attaching means by the magnet 440. The musician holds the guitar and plays the guitar in the conventional way. When the musician desires to play the harmonica, the musician easily grasps the harmonica and removes it from the attaching means and plays the harmonica. When the musician is finished playing the harmonic, the musician places the harmonica 300 back on the attaching means 400 where the harmonica is retained by the magnet 440. The guitar as illustrated is for a right handed musician. The invention can be used by a left handed musician by placing the attaching means on the bottom surface 170 of the guitar.

Figure 1B:
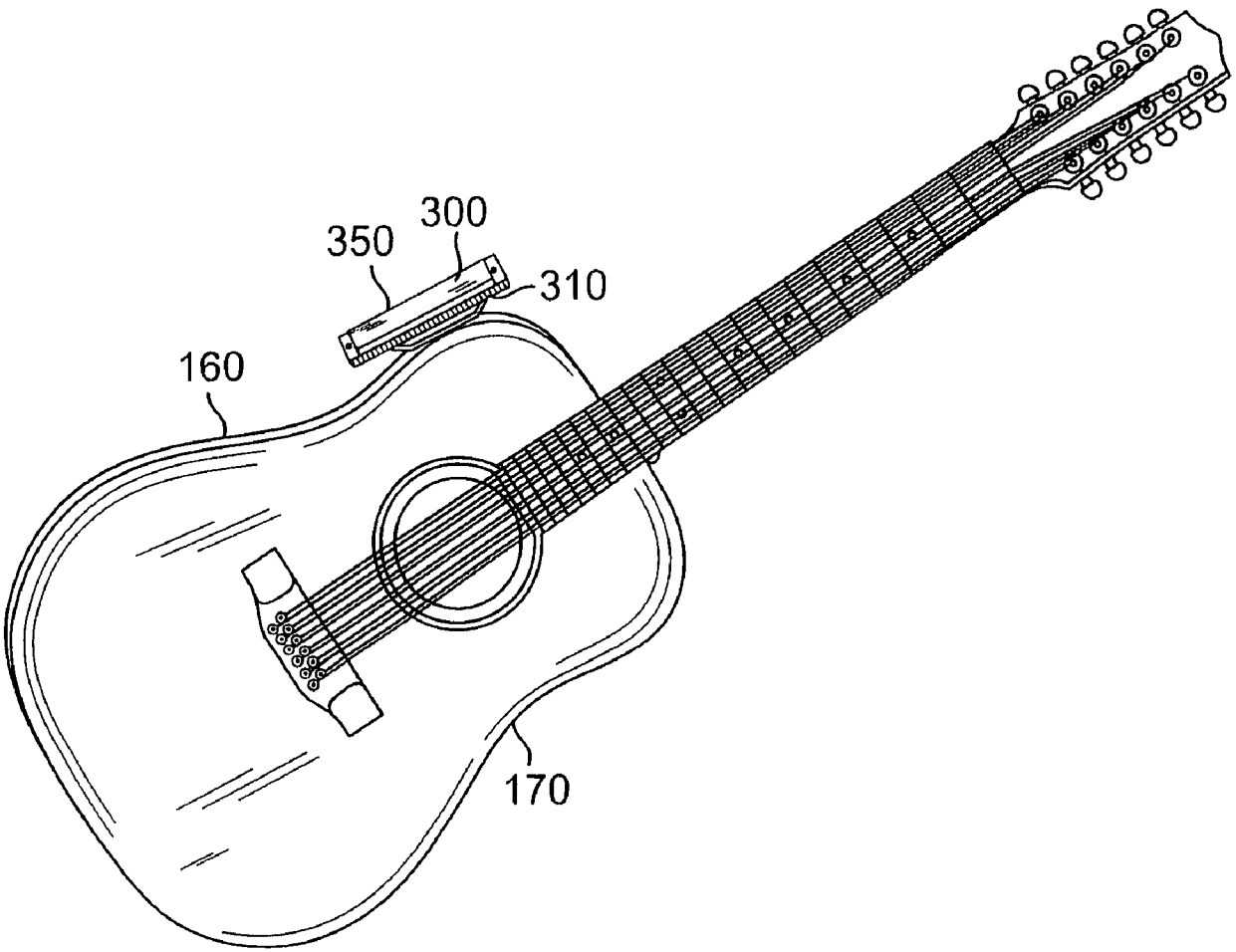
FIG. 1B is a perspective view of a guitar and a harmonica, with the harmonica being removably attached to the upper side of the guitar by the attaching means, with the harmonica retained in an a first alternative orientation.
Figure 1C:
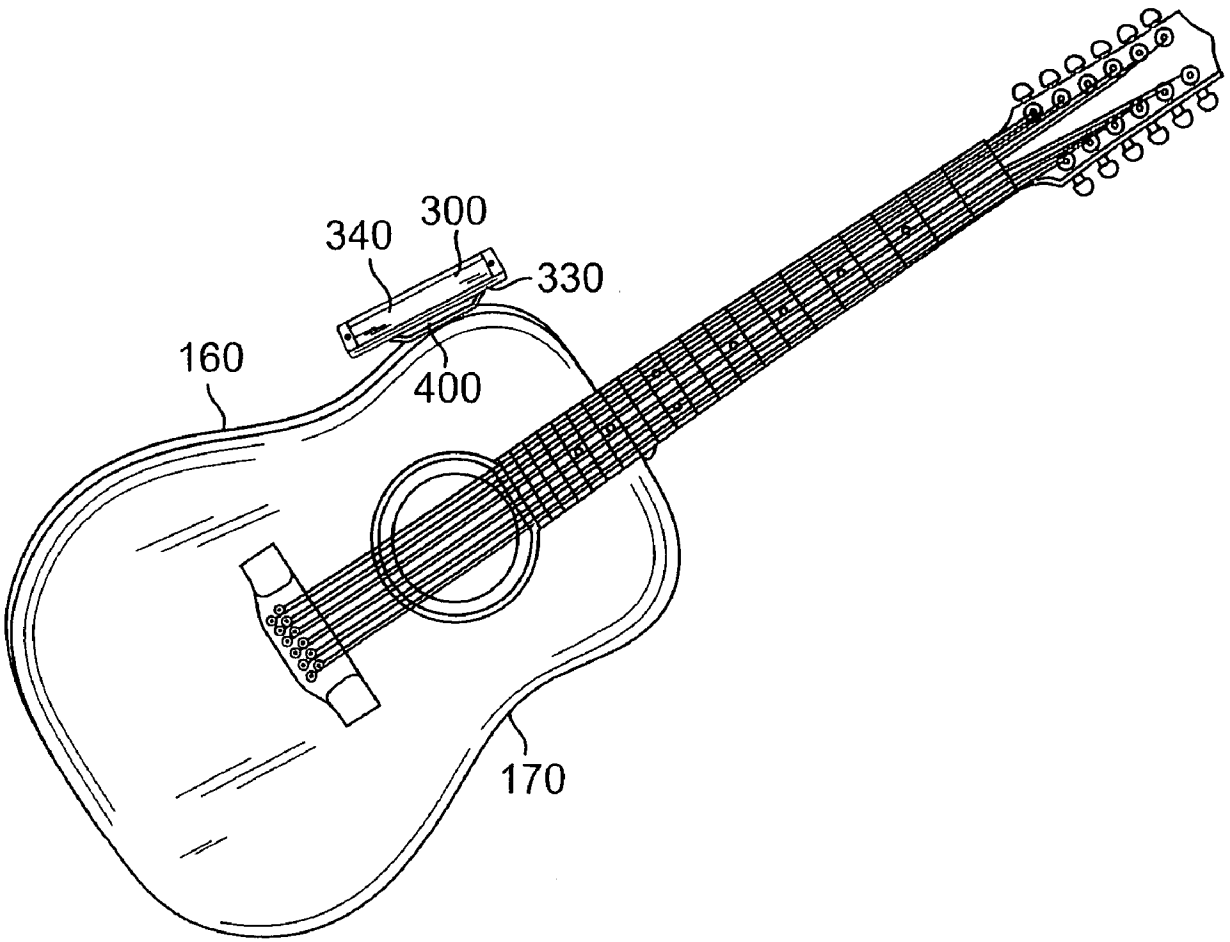
FIG. 1C is a perspective view of a guitar and a harmonica, with the harmonica being removably attached to the upper side of the guitar by the attaching means, with the harmonica retained in an a second alternative orientation.

It is also within the spirit and scope of the present invention to have the harmonica retained in any desired orientation on the magnet. Referring to FIG. 1B, the harmonica 300 is placed on its side 340 (see FIG. 1C) so that the mouth opening 310 faces away from the musician. Referring to FIG. 1C, the harmonica 300 is placed on its opposite side 350 (see FIG. 1C) so that the mouth opening 310 faces the musician.

Figure 1D:
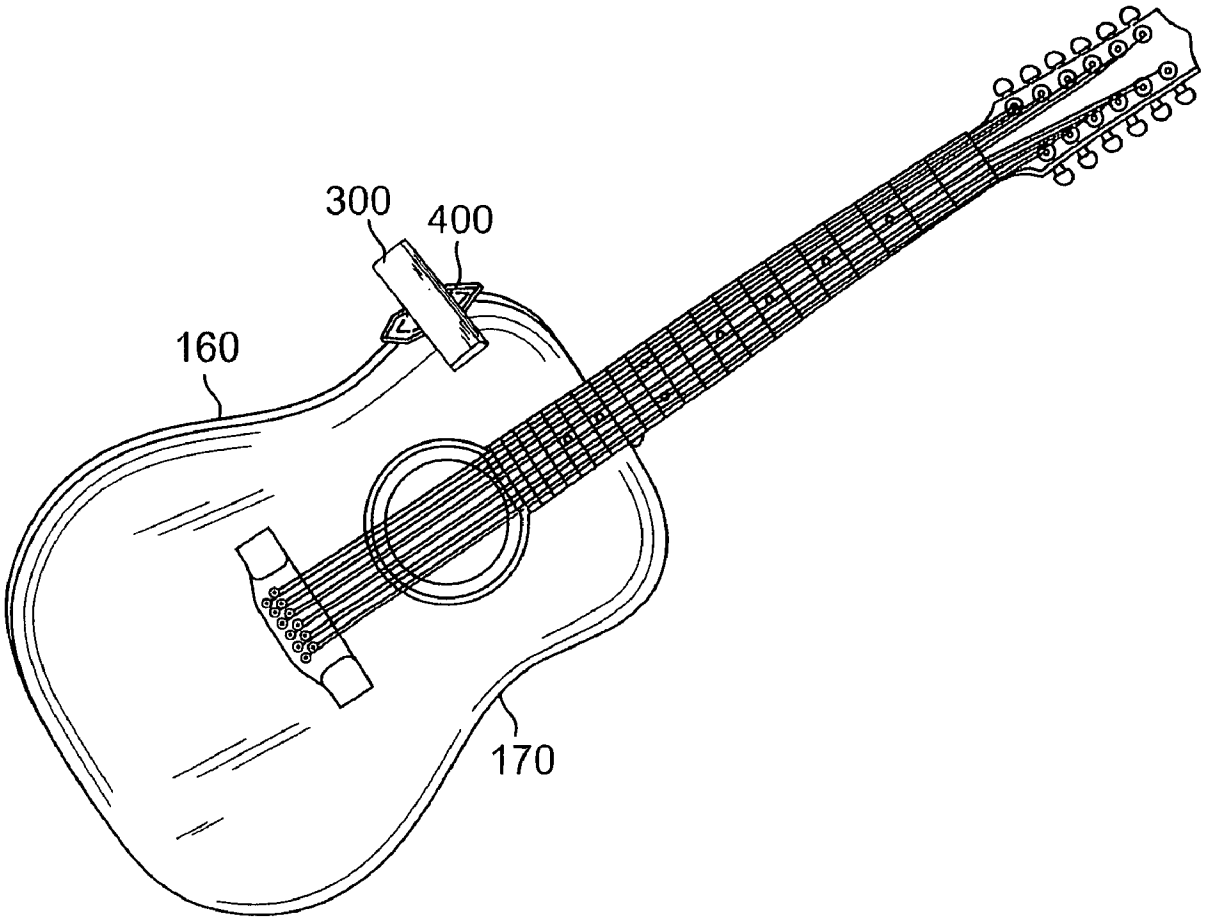
FIG. 1D is a perspective view of a guitar and a harmonica, with the harmonica being removably attached to the upper side of the guitar by the attaching means, with the harmonica retained in an a third alternative orientation.

In the orientations illustrated in FIGS. 1A through 1C, the harmonica 300 is positioned lengthwise on the attaching means 400 and oriented in the direction of the guitar body. As illustrated in FIG. 1D, the harmonica 300 can also be oriented transverse to the guitar body with one side (either 340 or 350) resting against the magnet 440.

It will be appreciated that the string instrument can be any string instrument in addition to a guitar such as a banjo, mandolin, cello, etc. It is also within the spirit and scope of the present invention to place the attaching means 400 at any location on the guitar 100 and not just the top surface 160. The attaching means 400 can be made of any material which is a capable of retaining a magnet in the exposed condition.

In addition, the present invention includes the concept of removably retaining a first musical instrument to a second musical instrument by a magnet. The attaching means of the present invention which includes the magnet is attached to the first musical instrument. The second musical instrument need only have a portion of it which has metal so that it an be removably retained to the first musical instrument by the magnet of the attaching means.

Defined in detail, the present invention is an apparatus to be used in conjunction with a guitar and a harmonica, the guitar having a guitar body including an upper surface, the harmonica having a body including a top surface having a mouth opening, a bottom surface made of metal, a pair of opposite sides made of metal, the apparatus comprising: (a) an attaching means including a body having an upper layer including a top side and a bottom side with an opening extending through the top and bottom side, a lower layer including a top side and a bottom side and attached to the upper layer so that the top side of the lower layer faces the bottom side of the upper layer, the bottom side of the lower having two sided tape affixed thereto so that one side of the two sided tape is attached to the bottom side of the lower layer and the opposite side of the two sided tape is covered with a peel off protector; and (b) a magnet retained between the bottom side of the upper layer and the top side of the bottom layer so that the magnet is positioned to be aligned with the opening in the top layer; (c) whereby after the peel off protector is removed, the exposed side of the two sided tape is affixed to the top side of the guitar so that the attaching means is affixed to the top side the guitar and the magnet faces away from the top side of the guitar so that any metal surface of the harmonica is removably retained by the magnet.

Defined broadly, the present invention is an apparatus to be used in conjunction with a guitar and a harmonica, the guitar having a guitar body including an upper surface, the harmonica having a body including at least one surface made of metal, the apparatus comprising: (a) an attaching means including a body which retains a magnet, the body also comprising affixation means; and (b) the body of the attaching means is attached to a portion of the body of the guitar by the affixation means of the body of the attaching means; (c) whereby the harmonica is removably retained on the attaching means by the magnet.

Defined more broadly, the present invention is an apparatus to be used in conjunction with a string musical instrument and a wind musical instrument, the string musical instrument having a body, the wind musical instrument having a body including at least one surface made of metal, the apparatus comprising: (a) an attaching means including a body which retains a magnet, the body also comprising affixation means; and (b) the body of the attaching means is attached to a portion of the body of the string instrument by the affixation means of the body of the attaching means; (c) whereby the wind musical instrument is removably retained on the attaching means by the magnet.

Defined most broadly, the present invention is an apparatus to be used in conjunction with a first musical instrument and a second musical instrument, the first musical instrument having a body, the second musical instrument having a body including at least one surface made of metal, the apparatus comprising: (a) an attaching means including a body which retains a magnet, the body also comprising affixation means; and (b) the body of the attaching means is attached to a portion of the body of the first musical instrument by the affixation means of the body of the attaching means; (c) whereby the second musical instrument is removably retained on the attaching means by the magnet.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus to be used in conjunction with a guitar and a harmonica, the guitar having a guitar body including an upper surface, the harmonica having a body including a top surface having a mouth opening, a bottom surface made of metal, a pair of opposite sides made of metal, the apparatus comprising:

a. an attaching means including a body having an upper layer including a top side and a bottom side with an opening extending through the top and bottom side, a lower layer including a top side and a bottom side and attached to the upper layer so that the top side of the lower layer faces the bottom side of the upper layer, the bottom side of the lower having two sided tape affixed thereto so that one side of the two sided tape is attached to the bottom side of the lower layer and the opposite side of the two sided tape is covered with a peel off protector; and b. a magnet retained between the bottom side of the upper layer and the top side of the bottom layer so that the magnet is positioned to be aligned with the opening in the top layer;

c. whereby after the peel off protector is removed, the exposed side of the two sided tape is affixed to the top side of the guitar so that the attaching means is affixed to the top side the guitar and the magnet faces away from the top side of the guitar so that any metal surface of the harmonica is removably retained by the magnet.

2. The apparatus in accordance with claim 1 wherein the upper layer and the lower layer of the attaching means are made of leather.

3. The apparatus in accordance with claim 2 wherein the upper layer and the lower layer of the attaching means are attached together by stitching.

* * * * *